US005456370A

United States Patent [19]

Goldring et al.

[11] Patent Number: 5,456,370

[45] Date of Patent: Oct. 10, 1995

[54] DISPLAY RACK

[75] Inventors: Harold B. Goldring, Woodcliff Lake, N.J.; Mark A. Niven, Yonkers; Ronald Namaroff, Hartsdale, both of N.Y.; Leslie G. Davis, North Caldwell, N.J.

[73] Assignee: Colgate-Palmolive Company, New York, N.Y.

[21] Appl. No.: 187,331

[22] Filed: Jan. 26, 1994

Related U.S. Application Data

[63] Continuation-in-part of Ser. No. 104,746, Aug. 11, 1993, Pat. No. 5,407,085.

[51] Int. Cl.[6] ..... A47F 5/00

[52] U.S. Cl. ..... 211/207

[58] Field of Search ..... 211/207, 175, 211/59.3

[56] References Cited

U.S. PATENT DOCUMENTS 1,452,659 4/1923 Seelman .
3,393,688 7/1968 Saverino .
3,780,873 12/1973 Silva .

*Primary Examiner*—Alvin C. Chin-Shue
*Assistant Examiner*—Sarah L. Purol
*Attorney, Agent, or Firm*—Robert C. Sullivan; Richard J. Ancel

[57] ABSTRACT

An adjustable tilt construction for a toothbrush display rack. The rear wall of the rack is provided with one or more T slots, each slot receiving one of two parallel flanges of a respective leg, said leg being generally H shaped in transverse cross section over at least a portion of its length. One flange of each leg is shorter than the other, and is asymmetrically located with respect to it so as to yield two different distances from the ends of the shorter flange to respective ends of the longer flange. This leg configuration permits three different leg heights by inserting each leg into a respective slot in three different ways. In turn, this permits three different tilt angles for the display rack. Each leg has at least one end having biased edges which releasably frictionally fit into the T shaped slots on the rear wall of the rack. The leg and slot configuration may also be used on any member to provide height adjustment.

14 Claims, 11 Drawing Sheets

FIG. 7
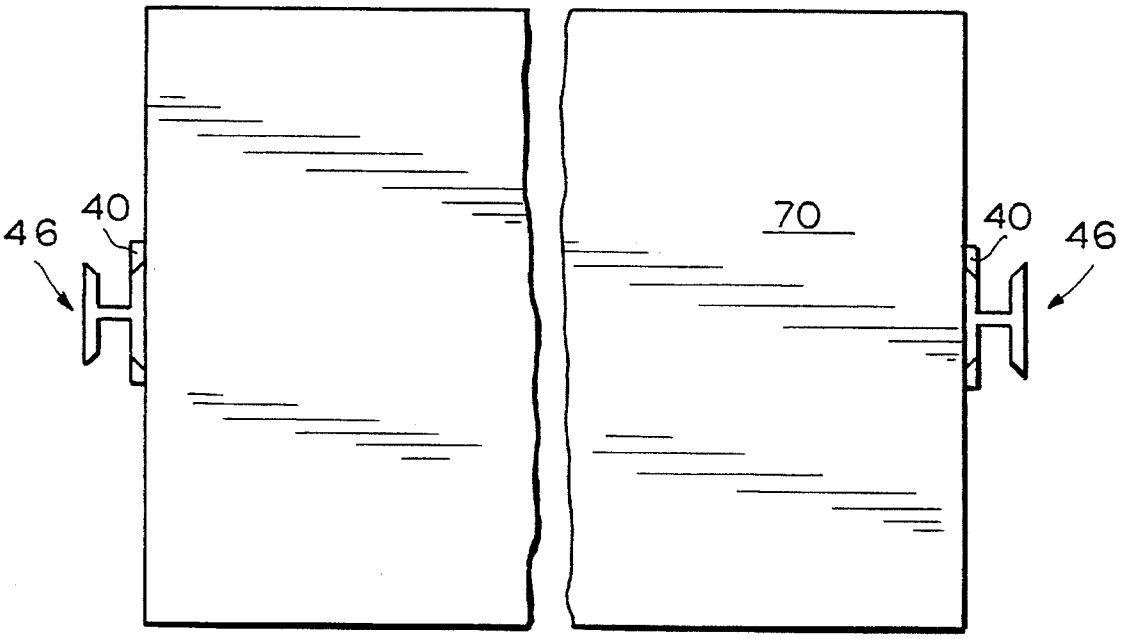
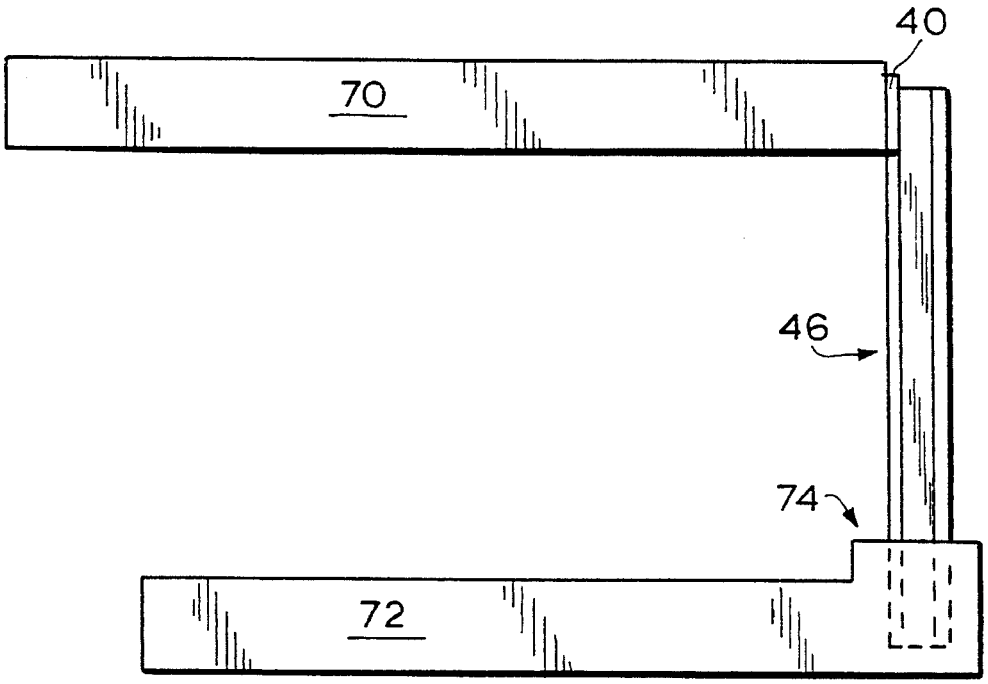
FIG. 8

DISPLAY RACK

This invention is a continuation in part application of application Ser. No. 08/104,746 filed Aug. 11, 1993 now U.S. Pat. No. 4,407,085entitled Display Rack.

BACKGROUND OF THE INVENTION

This invention relates to a tiltable display rack particularly adapted for toothbrushes. Racks for displaying similar items for retail sale are known. For example, U.S. Pat. No. 3,780,873 issued to Silva shows a tilted rack having a plurality of parallel troughs, with a pusher weight behind each row of the displayed articles in each respective trough, the pusher weights functioning by gravity. The use of pusher weights in display racks is also shown in U.S. Pat. No. 1,452,659 issued to Seelman and U.S. Pat. No. 3,393,688 issued to Saverino.

While satisfactory for their respective purposes, these and other known constructions do not yield a toothbrush display rack whose angle of tilt may be easily varied.

SUMMARY OF THE INVENTION

According to the practice of this invention, a toothbrush rack is provided with a rear leg construction which permits the angle of inclination of the toothbrush rack to be varied. This is effected by a novel slot and leg configuration, with two such legs in their respective slots usually employed. Each leg is in the general form of an H beam having two parallel and elongated flanges joined by a central web, with the plane of the central web being orthogonal to the parallel flanges. One of the two flanges of the leg is shorter than the other. The respective ends of the shorter of the two flanges terminate at different distances from neighboring or contiguous respective ends of the flange of greater length. Each slot is open on one side and is located at the rack rear wall and receives a respective leg, the rack being typically provided with two of the H legs, each slot having an uppermost or abutment. In use, a leg is slidably inserted into a slot in any one of three different ways. In the first way, either end of the longest flange abuts the slot top. In the second way, one end of the shorter flange abuts the slot top, while in the third way the other end of the shorter flange abuts the slot top. These three ways of leg insertion into a respective slot yield three different degrees of tilt to the display rack. To obtain a different tilt, each leg is slid out of its slot, turned or rotated, and then reinserted. In a modification, either end of the shorter flange of the (modified) leg can be inserted into a slot, while only one end of the shorter flange can be inserted.

The novel leg and slot construction of this invention may also be employed to vary the height of a table or other horizontal support surface member by providing at least one slot adjacent the support member periphery and using the novel leg of this invention to effect height adjustment by inserting the leg into the slot in the same three different ways as in the toothbrush display rack. Thus the leg yields different heights for different supports.

BRIEF DESCRIPTION OF THE DRAWINGS

FIG. 7 is a top plan view of a table provided with the leg and slot construction of this invention, so as to produce an adjustable height table.

FIG. 8 is a side elevational view of a table, slot and leg arrangement similar to that of FIG. 7, and wherein only a single supporting leg of adjustable height is employed.

DETAILED DESCRIPTION OF THE INVENTION

Figure 1:
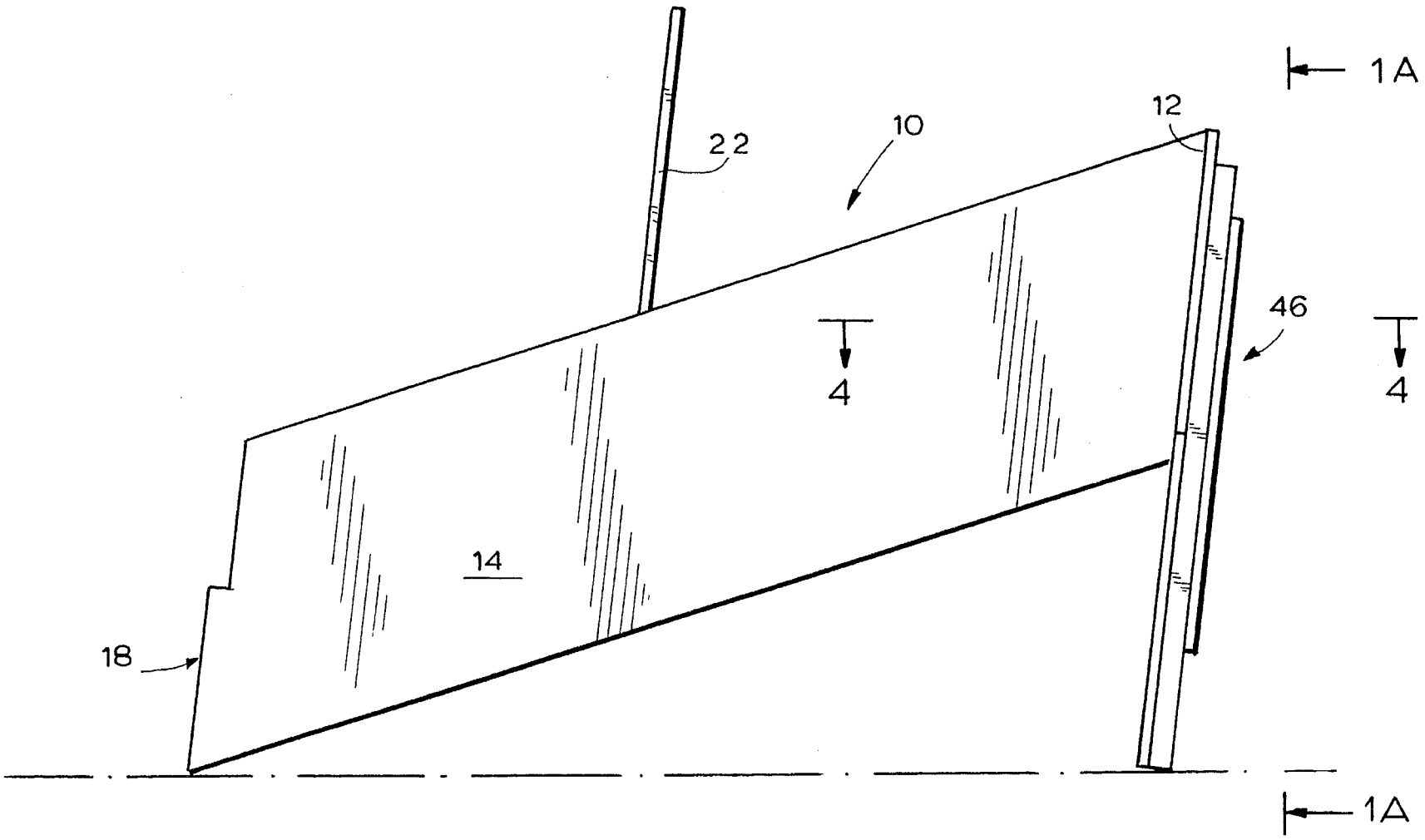
FIG. 1 is a side elevational view illustrating the toothbrush rack in its highest tilt position.
Figures 1A, 2A, 3A:
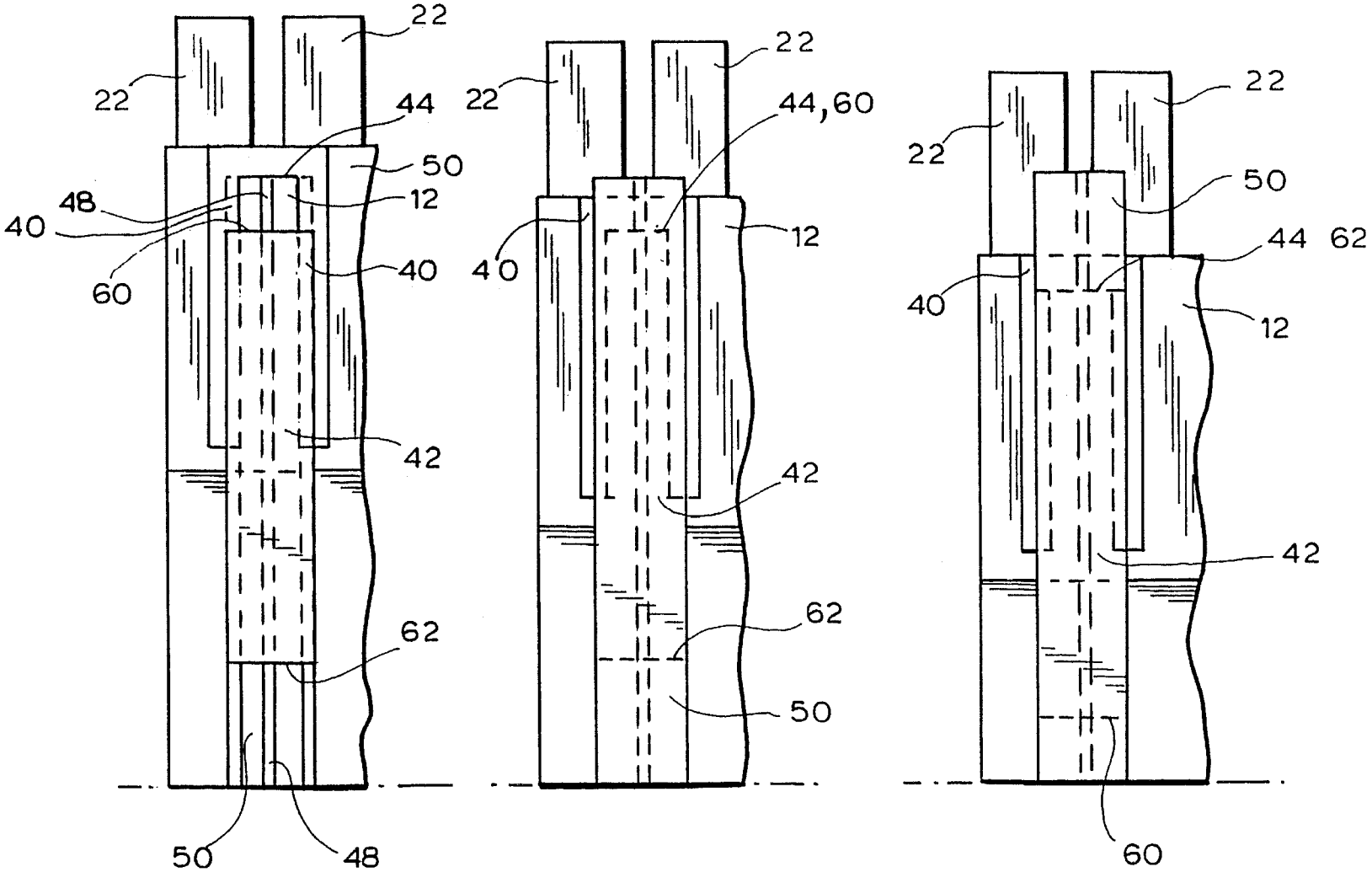
FIG. 1A is a rear view of the rack of FIG. 1 taken along 1A—1A of FIG. 1.
FIG. 2A is a rear view of the rack of FIG. 2 taken along 2A—2A of FIG. 2.
FIG. 3A is a rear view of the rack of FIG. 3 taken along 3A—3A of FIG. 3.
Figure 2:
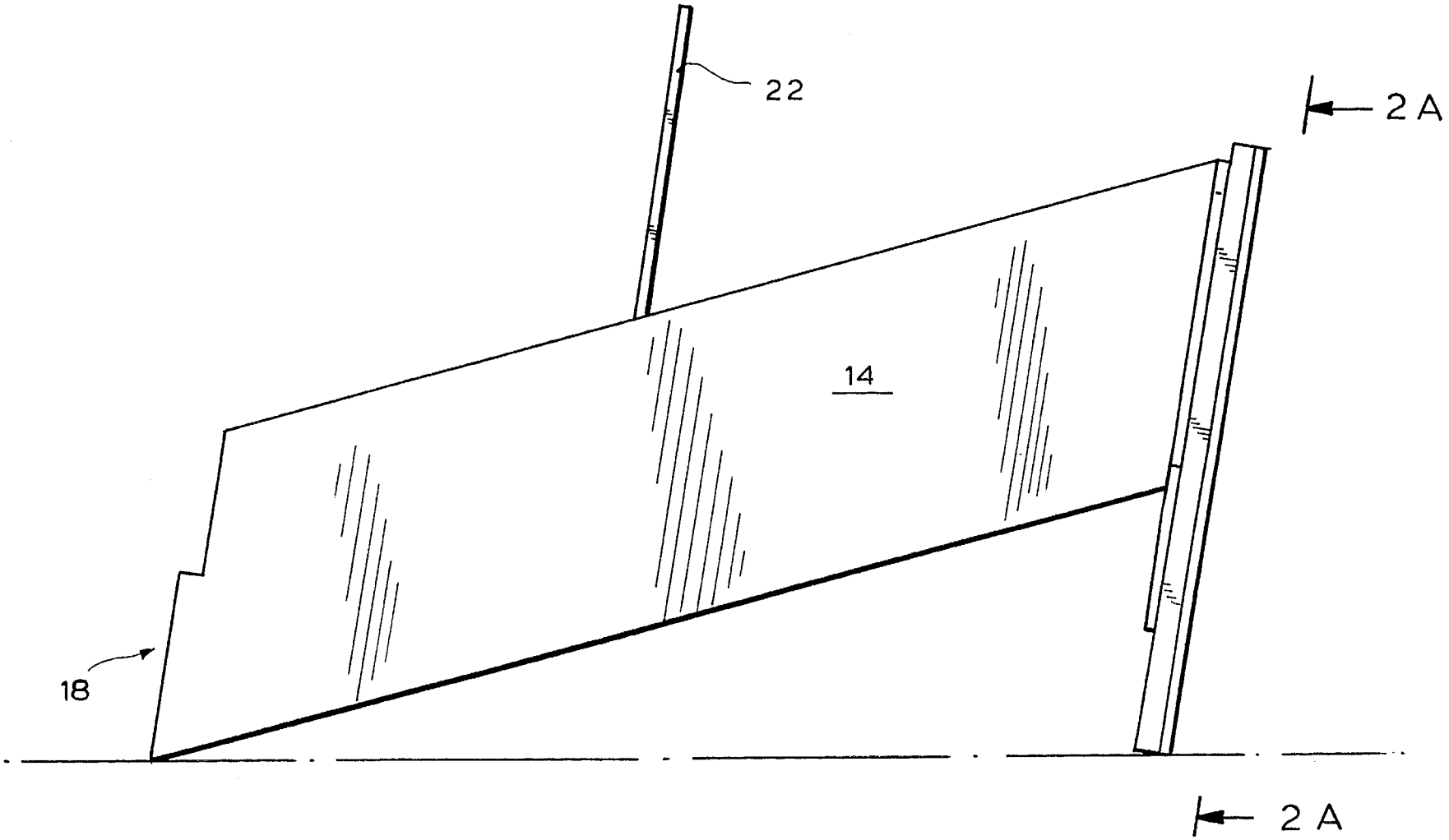
FIG. 2 is a view similar to FIG. 1 is showing the toothbrush rack in a second and lower tilt angle.
Figure 3:
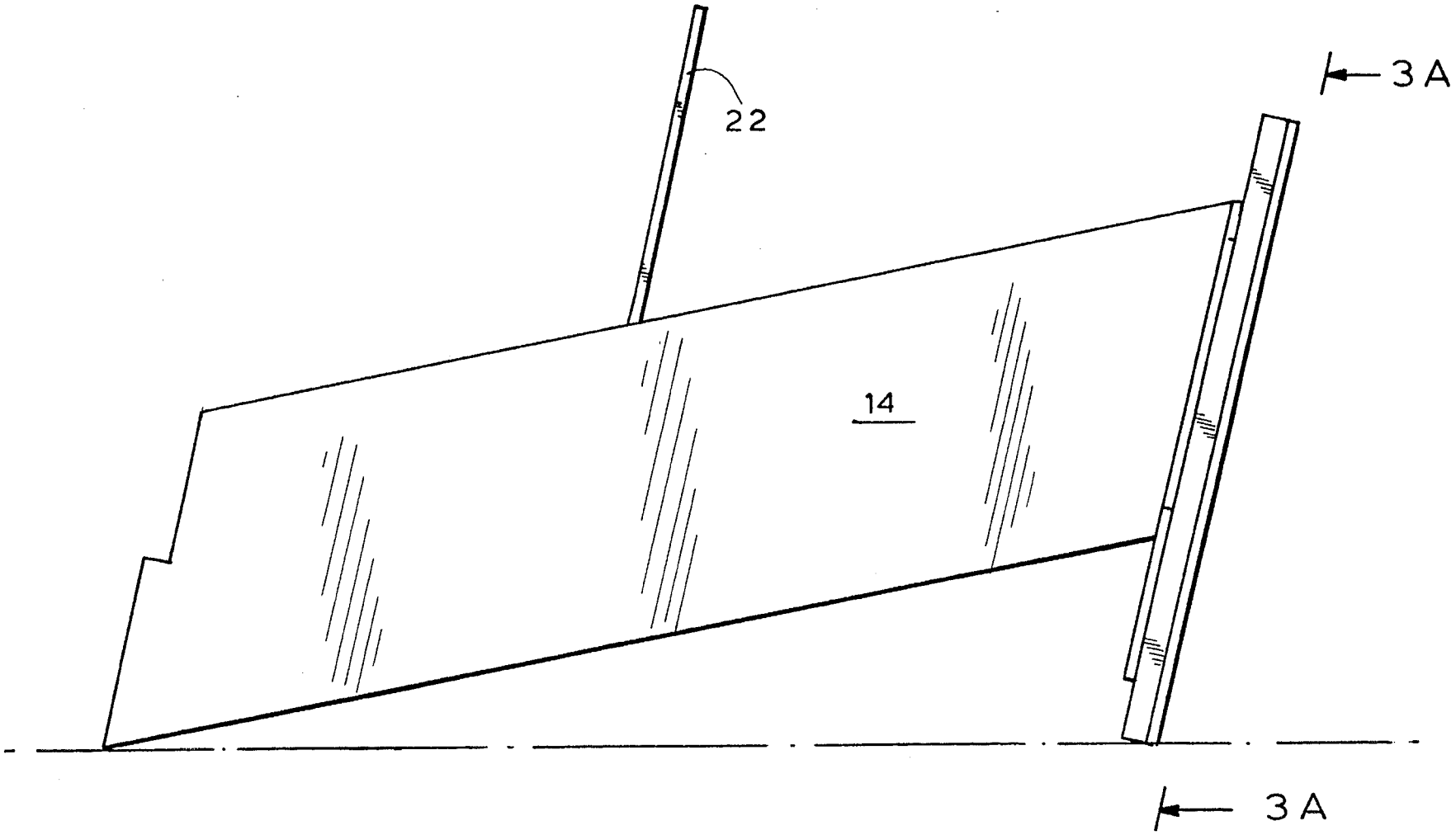
FIG. 3 is a view similar to FIG. 1 and shows the toothbrush rack in yet a third and lowest tilt angle.

Referring now to FIGS. 1–3 of the drawings, the toothbrush rack of this invention is generally indicated as 10 and includes a rear wall 12, a pair of opposite and parallel side walls 14, only one of which is seen at FIG. 1, and a front wall 18. One or more legs 46, only one of which is shown, is inserted into a slot in or at rear wall 12, so as to provide a first degree or angle of tilt to tray 10. Upstanding element 22 represents the rear portion of a pusher element, shortly to be described.

FIGS. 2 and 3 are similar to FIG. 1, with FIGS. 1, 2, and 3 differing only in the degree of tilt of the rack tray. These different angles or degrees of tilt are achieved by different manners or ways of inserting legs 46 into their respective slots, as will shortly be described.

Figure 5:
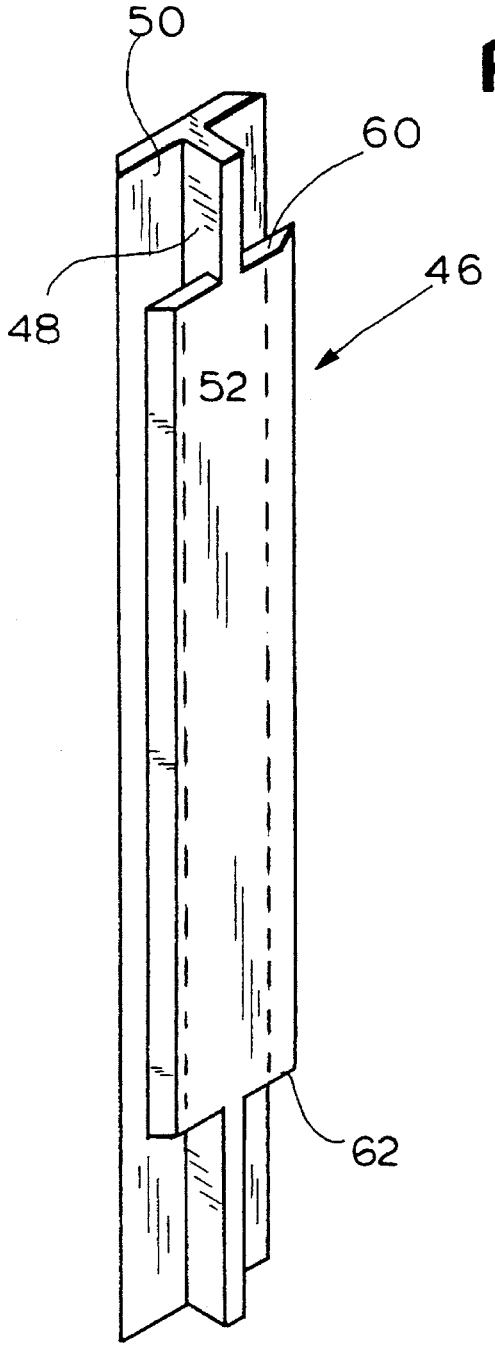
FIG. 5 is a first perspective view of a rear supporting leg according to the practice of this invention, the leg adapted to be inserted into a respective slot at the rear of the toothbrush rack.
Figure 6:
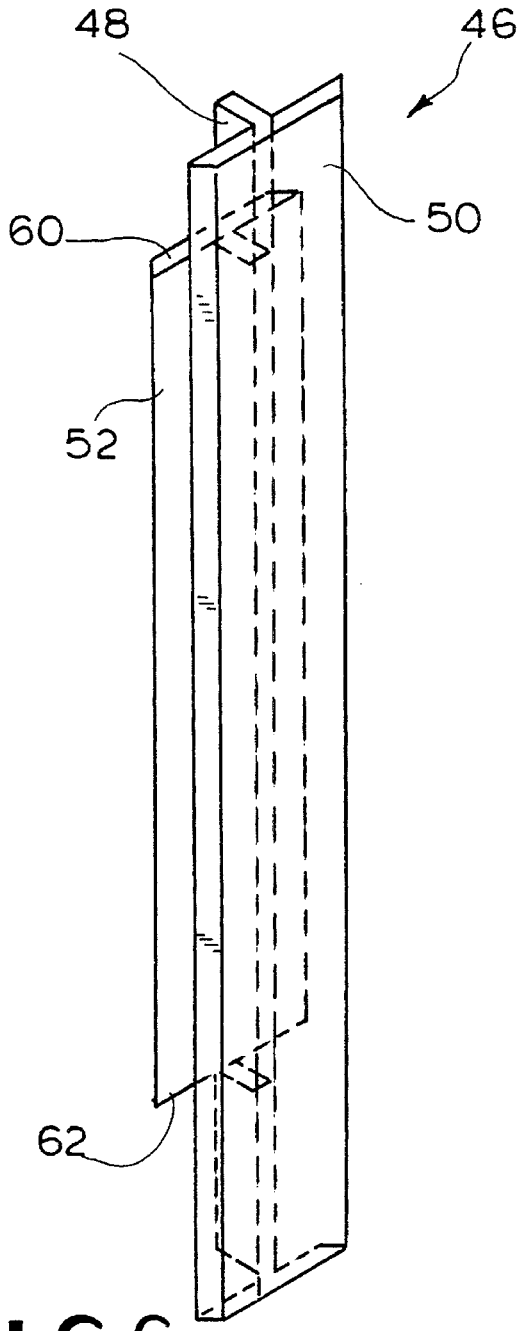
FIG. 6 is a view similar to FIG. 5, but taken at about 180° from the perspective of FIG. 5.

FIGS. 1A, 2A, and 3A illustrate the three ways of inserting a leg 46 shown at FIGS. 5 and 6, into a respective slot.

Figure 4:
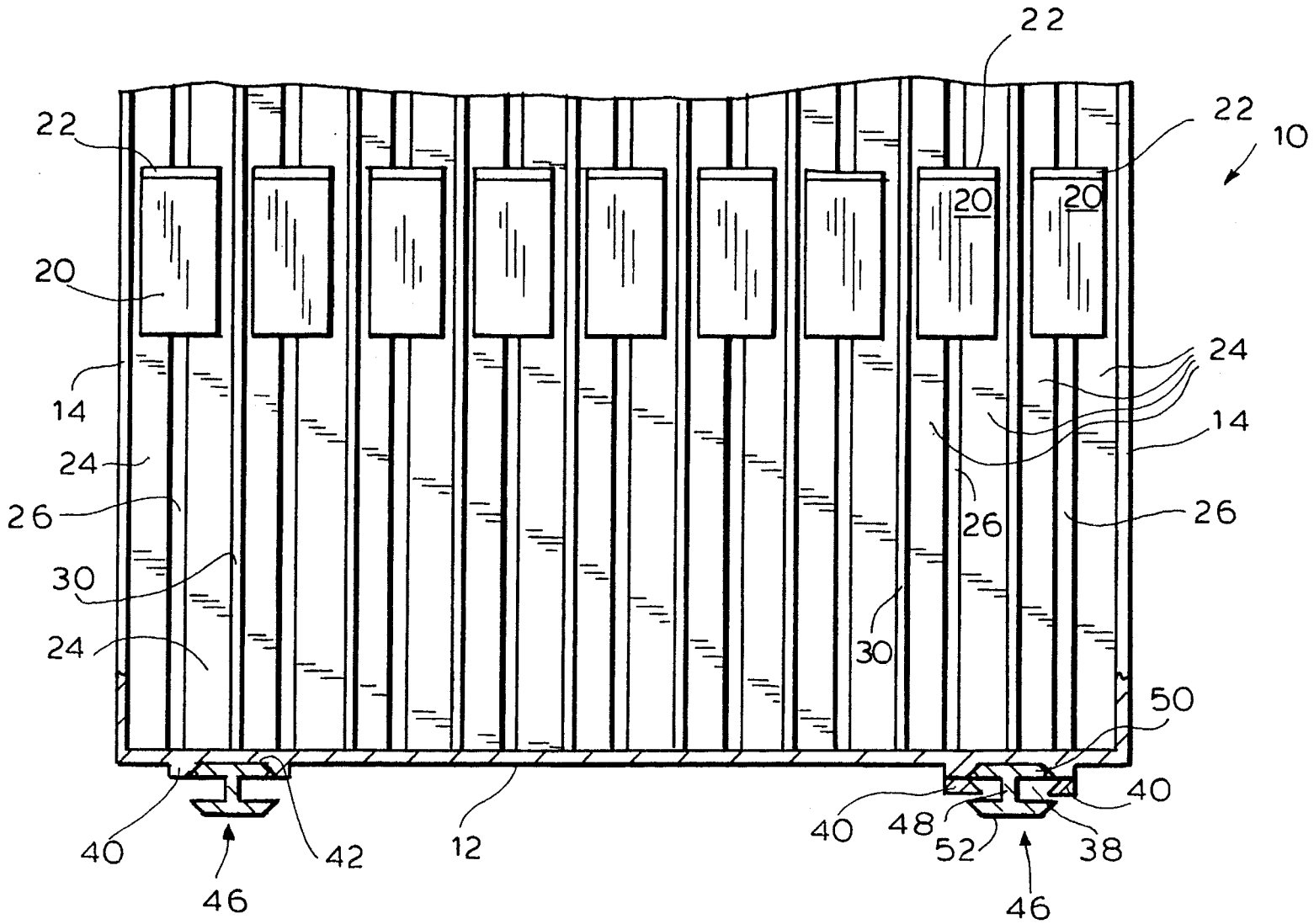
FIG. 4 is a view taken along section 4—4 of FIG. 1.

Referring now to FIG. 4, tray 10 is shown as including a plurality of gravity operated pusher elements each having substantially flat surface portions 20 integrally connected to upstanding and vertically extending back portions 22. Pairs of trough defining areas 24 are separated by respective gaps 26, with each of the area pairs 24 bordered by walls 30. Flat, lower surface portions 20 are typically provided with T shaped tongues which engage the lower, opposite sides of respective areas 24, with the webs of the tongues extending through respective slots 26. The rack may be formed of a plastic material or of metal.

As known in this art, each back portion 22 is urged by gravity against the rear toothbrush container of a row of toothbrush containers, such that when a purchaser takes the front toothbrush container from a row, at the lowest or front rack portion, the pusher associated with that row forces the remaining toothbrush containers in that row down so as to fill the gap caused by the purchaser-removed lowermost toothbrush container. Clearly, the magnitude of the gravity derived pusher force on the rear of its respective row will vary with the angle of tilt of the rack. In order to vary the pusher force, according to this invention, it is only necessary to vary the manner or way in which each leg is inserted into its respective slot at the rear of the rack. It will be understood that each leg, when plural legs are employed, must be inserted into its respective slot in the same way so that the 20 rear of the rack will be level.

As seen at FIGS. 4 and 1A, 2A, 3A, each rear slot 38 is generally T shaped in transverse section and is defined by spaced overhangs or flanges 40, with the lower, open end of each slot denoted as 42 and the upper end having an abutment or closed portion 44, the latter being optionally defined by a horizontal continuation of flanges 40. Each slot may be integral with the rear rack wall 12, or may be separately formed and affixed to the rear wall.

Referring now to FIGS. 5 and 6 of the drawings, a typical leg 46 is illustrated. The major length of each leg is in the general form of an H rigid beam. The web portion of each leg is designated as 48, the longest flange designated as 50, while the shortest flange is designated as 52. One end of shorter flange 52 is designated as 60, while the other end of flange 52 is designated as 62. It will be observed that end 60 is closer to a corresponding, neighboring end of longer flange 50 than is end 62 to its closest or neighboring end of longer flange 50. Shorter flange 52 is seen to be asymmetrically located, in a manner parallel to the leg, with respect to the longer flange 50.

Referring now to FIGS. 1A and 4, a leg 46 has been placed into its respective slot 38 through lower slot opening 42, so that the upper end of flange 50 contacts upper abutment 44 of slot 38. This is done for both of the legs shown at FIG. 4 and yields, as shown at FIG. 1, the maximum angle or degree of tilt of rack 10 since the rack rear is elevated by the length of longer flange 50.

Again referring to FIG. 4 and FIG. 2A, leg 46 has been inserted into slot 38 such that upper end 60 of shorter flange 52 is in contact with upper slot abutment 44 of slot 38. FIG. 2 shows that the angle of tilt of the rack is now less than that shown at FIG. 1.

Referring now to FIG. 3A and FIG. 4, leg 46 has been inserted into slot 38 so that end 62 of shorter flange 52 is in contact with upper slot abutment 44. Considering FIG. 3, the reader will readily see that this yields the lesser tilt of the three tilt angles shown at FIGS. 1, 2, and 3.

In each of these three ways of leg insertion, FIG. 4 shows that one flange of the leg is in the slot while the other flange is located outside of the slot. The T shaped slot is thus substantially occupied by one half of the H leg.

FIGS. 5 and 6 show that over the major portion of the length of each leg 46, the cross section is generally that of an H shaped beam. Beyond the ends of flange 52, the transverse cross section may be described as T shaped. FIG. 4 shows that only one of the two parallel flanges, at any position of the leg in a respective slot 38, extends outwardly beyond slot 38. The flange edges are illustrated as bevelled, although this is not required. Typically, legs 46 are of the same material as that of the rack, but are rigid in any case. It will be apparent that if shorter flange 52 were symmetrically located relative to longer flange 50, then only two different degrees of tilt of the tray would be possible. While not as useful as the leg shown at FIGS. 5 and 6, wherein the shorter flange is asymmetrically positioned relative to the longer flange, the symmetrical location of shorter flange 52 is nonetheless useful in producing two different tilt angles.

While exhibiting utility in the display rack technology, it will be apparent that the novel leg and slot construction of this invention may also be used to vary the height of a table or other horizontal support member. Some peripheral portion of the table is provided with slots 38 and legs 46 shown at FIGS. 5 and 6 placed in each slot. By varying the manner or way of placement of each leg into its respective slot (as with the toothbrush rack), the height of the table may be varied. Such a construction is shown at FIG. 7 where two opposite ends of a table 70 are each provided with the T slot and H leg construction previously described. Alternatively, as shown at FIG. 8, only a single slot and leg may be used to support a table 70 by providing an elongated supporting foot 72 having an H shaped socket 74 receiving the bottom end of the H leg. The length of foot 72 is such as to preclude cantilever tilting of the table.

A typical manner of forming each of the legs 46 of this invention will now be set forth. Injection molding, extruding with post fabrication and/or manual assembly are proposed methods. Note that other methods such as roll forming can be used. Similarly, a typical manner of forming the display rack is as follows: injection molding, stamping, manual assembly, etc. A typical manner of forming the slots 38 is as follows: injection molding, stamping, routing, etc.

Another embodiment of the invention will now be described with reference to FIGS. 9–15. This second embodiment similar to that described above and shown in FIGS. 1–8, with the second embodiment disclosing certain variations in several of the components of the display rack. In general, the same reference numerals will be used to denote corresponding elements, with different reference numerals being employed to describe variations in the structure shown in the second embodiment.

Figure 9:
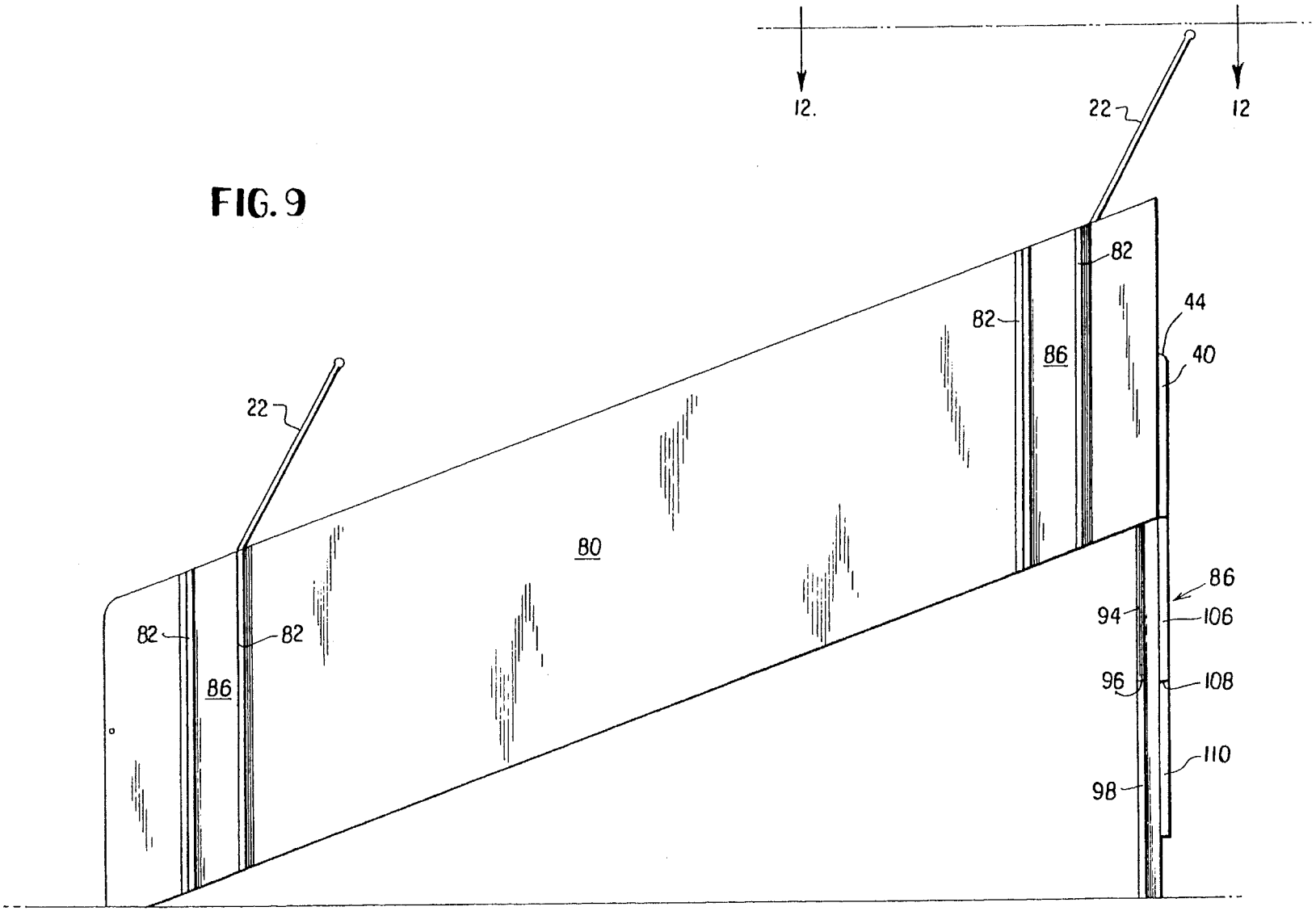
FIG. 9 is a side elevational view, similar to that of FIG. 1, of a second embodiment of the display rack of this invention.

Referring now to FIG. 9, a side elevational view of the display rack of this invention in one of its tilt or angular positions is shown. The side wall facing the reader is designated as 80 and is similar to side wall 14 of FIG. 1, except for the addition of side rails 82 at both ends, with each pair of these side rails defining slots 86 for the reception of spacer legs therein. A consideration of FIG. 9 will shown that if it is desired to vertically stack two or three of the display racks above one another, it is only necessary to insert correspondingly shaped legs into slots 86. The other side wall 80 also has corresponding slots 86 so that in stacking one tray vertically spaced with respect to a lower tray four such stacking legs are employed. It will be understood that the stacking feature afforded by slots 86 is optional in the construction of the display rack. Also optionally, side rail pairs 82, 82 on one side wall 80 may be differently spaced from the ends of respective left and right side walls 80. This enables the display racks to be coupled together to tandem, side by side relation.

FIG. 9 shows one of two rear legs 86 fitting into a complimentary slot defined by overhang of flange elements 40, similar to that shown at FIG. 4. The details of each leg 86 will now be described with respect to FIGS. 10 and 11.

Figure 10:
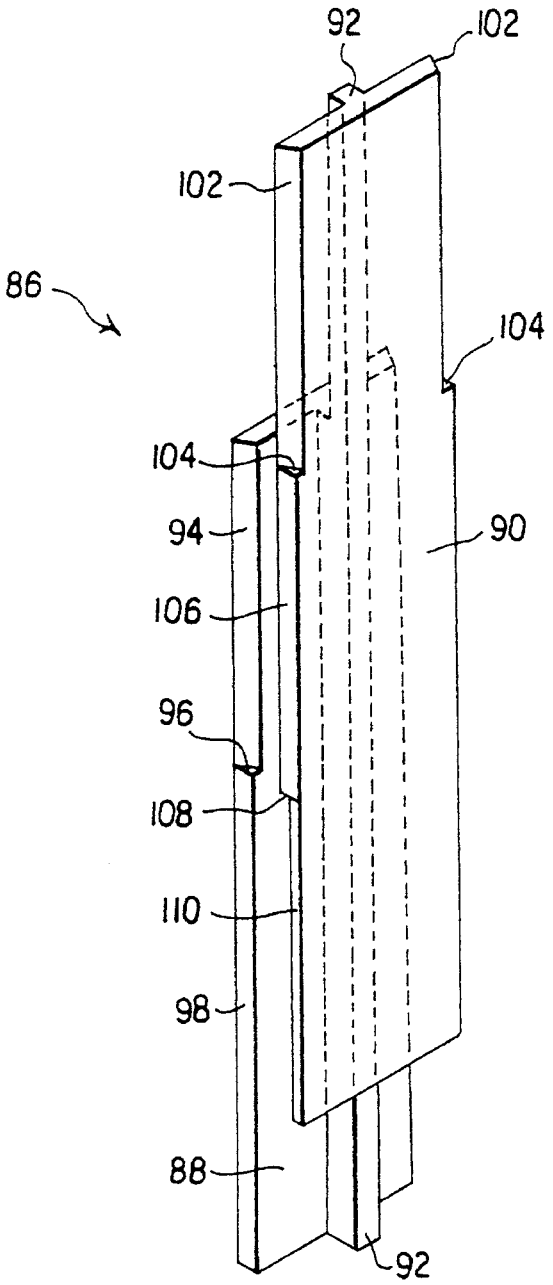
FIG. 10 is a perspective view, similar to FIG. 5, of a second embodiment of a rear supporting leg.
Figure 11:
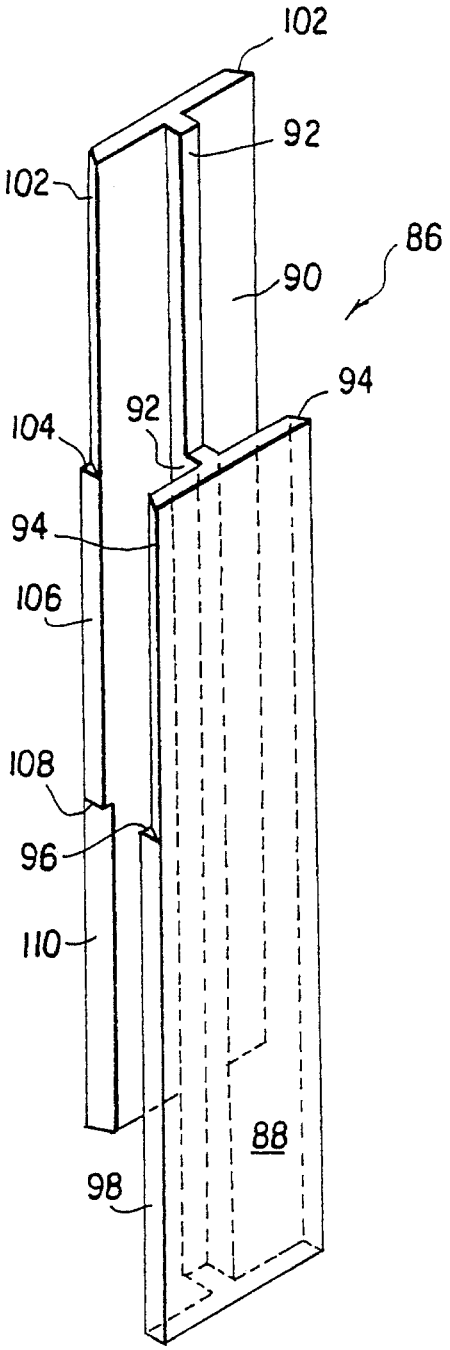
FIG. 11 is a view similar to FIG. 10, but taken about 180 degrees from the perspective of FIG. 5.

Referring now to FIGS. 10 and 11, FIG. 10 is a perspective view of a leg 86 according to this second embodiment, with leg 86 being similar to leg 46 shown at FIGS. 5 and 6. Again, each leg is fashioned (typically of molded plastic) of two elongated flanges joined in spaced and parallel relation to each other by a central, orthogonal web. The flanges are designated as 88 and 90, and the web between them designated as 92. Again, the two flanges in the web are generally H-shaped in cross section. Referring now to flange 88 of FIG. 10, the upper edges are both biased to present slanted surfaces 94. Each edges surface 94 continues downwardly until an abutment or shoulder 96 is reached, and thereafter flat edges 98 continue down to the bottom of flange 88. Thus, from the bottom of flange 88 up to shoulder 96, flange 88 is rectangular in transverse cross section, while above abutment 96, flange 88 is in the form of a regular trapezoid. This is entirely similar to the trapezoidal cross section of leg 46 previously described.

Turning now to the other flange 90, it is seen that its upper portion is that of a regular trapezoid in transverse cross section with shoulders 104 located at the bottom portion of slanted or biased edges 102. The middle section of flange 90 is rectangular in cross section with its edges denoted as 106. The lower portion of the middle section of flange 90 is designated as 108, and is similar to shoulders 104, with biased edges 110 on the lower third of flange 90. Edges 102 and 110 are biased at the same angle, but in opposite senses.

FIG. 11 is a view similar to FIG. 10 but taken at an angle of 180 degrees therefrom. Thus, FIG. 11 may be regarded as FIG. 10 with the leg 86 having been rotated about its own longitudinal axis 180 degrees.

Figure 12:
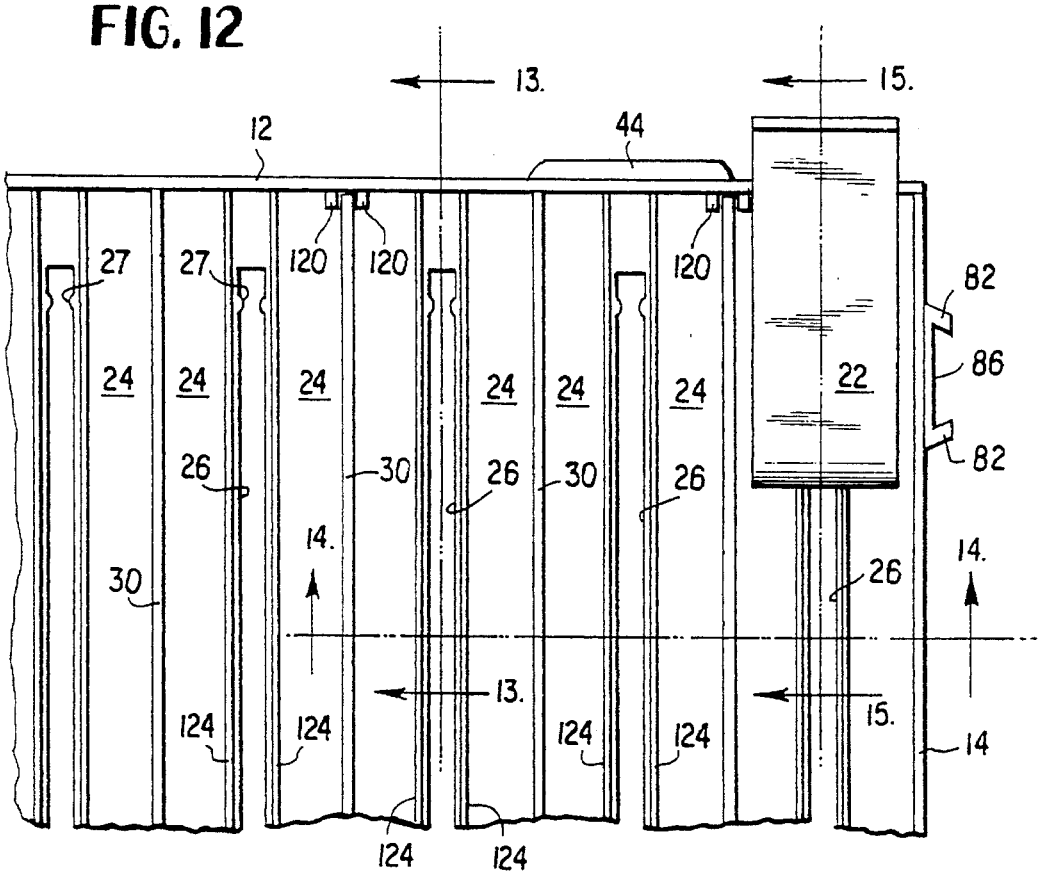
FIG. 12 is a view looking downwardly from location 12—12 of FIG. 9.

Referring now to FIG. 12, spaced bottom areas of the individual toothbrush receiving channels of the rack are designated as 24 and are separated by a gap to define slots 26. The rear or upper end of each slot 26 (nearest the rear wall of the rack) is provided with oppositely projecting dimples or protuberances 27, preferably integrally molded with the plastic from which the display rack is formed. Parallel walls 30 separate and define individual troughs or channels in the rack, with every other wall 30 having its rear vertical edge positioned between vertically running abutments 120. FIG. 12 shows one of the gravity operated pusher elements. Rearmost sidewall slot 86 of right side wall panel 14 is shown at the right portion of FIG. 12. FIG. 12 also illustrates abutment flanges 44 at the top of flanges 40, the latter defining vertically running slots 38 (see FIG. 4) which accept and receive complimentary portions of legs 86, with abutment flanges 44 extending horizontally at the top of each rear wall vertical slot to form abutments limiting upward motion of each leg 86. FIG. 12 also illustrates parallel raised portions 124 on both sides of each slot 26. Rails or raised portions 124 reduce friction between the bottom of the pusher elements 20 and slots 26.

Figure 13:
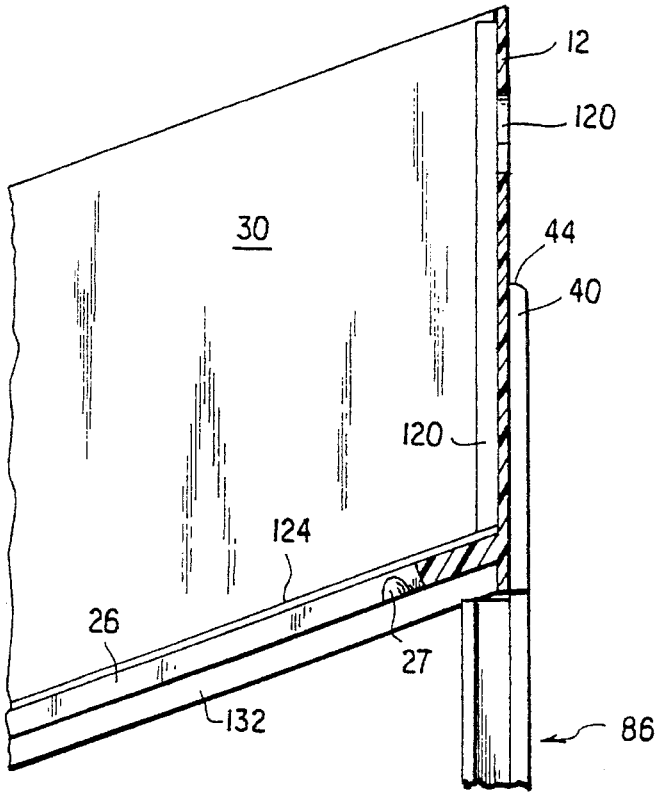
FIG. 13 is a view taken along section 13—13 of FIG. 12.

FIG. 13 shows one of the protuberances 27 projecting towards the reader in one of the slots 26, and also shows one of the rails 124 associated with a slot 26. One leg 86 is also illustrated in one of the rear wall leg receiving slots.

Figure 14:
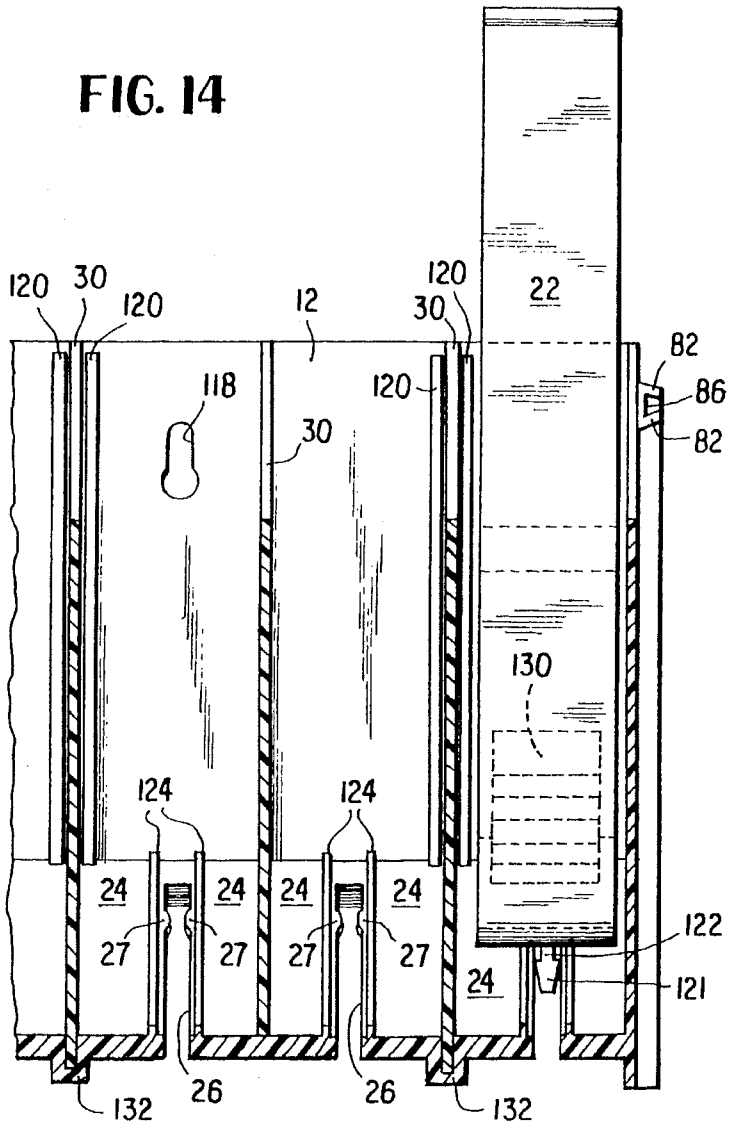
FIG. 14 is a view taken along section 14—14 of FIG. 12.

Referring now to FIG. 14, rear wall 12 has been provided with two horizontally spaced keyhole slots 118, only one of which is shown, for mounting the display rack on a vertical wall by means of a screw, nail or the like, if desired. It will be understood, however, that the preferred manner of using the rack is on a horizonal surface and employing legs 86. FIG. 14 illustrates elongated recesses 132 at the rack bottom for receiving the lower horizontal edges of every other channel or trough defining side wall 30. The remaining, alternate side walls 30 are integrally molded with the rack.

Figure 15:
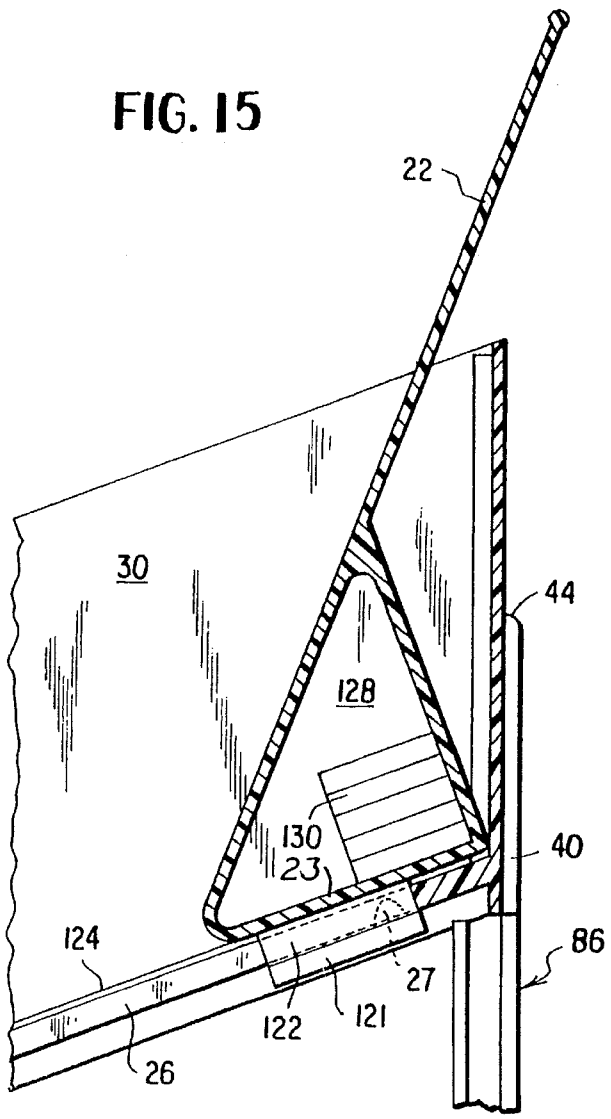
FIG. 15 is a view taken along section 15—15 of FIG. 12.

FIG. 15 is a view showing the construction of the gravity operated pusher elements with the lower portion of each being open and defining a triangular zone 128, open at both sides, and receiving a weight 130 which may assume the form of a plurality of individual metal weights held together by glue and resting on the inside of flat run 23 of each pusher. The lower portion of each flat run or portion 23 of the bottom triangular portion of each pusher element carries a tongue 122, preferably integral with each pusher, the tongue having a lower enlarged portion 121, with each tongue 122 spanning the depth of its respective slot 26. With movement upwardly of any pusher to 27, there will be a frictional but releasable engagement between the sides of tongue 122 and protuberances 27. This temporary position of each gravity operated pusher permits the retailer to load a plurality of toothbrushes in each of the individual troughs of the display rack. After such loading, the pusher 20 is manually urged in a downward direction, parallel to its respective slot 26, to thereby release the frictional engagement occasioned by protuberances 27. Each pusher element 20 is retained in a respective slot 26 by inserting enlargement 121 (which is preferably tapered at its lower end as shown at FIG. 14) into the slot, so that the slot deforms somewhat while enlargement 121 also deforms somewhat to enable it to pass through the slot. Tongue 122 is slightly narrower than each slot 26, while enlargement 121 is wider at its widest part than each slot 26.

Geometrical terms of orientation such as vertical and horizontal are used to facilitate the description and are not intended as limiting.

We claim:

1. An adjustable height leg construction for a member to be supported at several heights, a portion of said member having an open, vertically extending T shaped slot, said slot being open at its lower end, the upper end of a leg removably and slidably received in said slot, said leg having at least a portion of its length in the shape of an H shaped beam having a central web and two flanges, one of said two flanges being shorter than the other of said flanges, one end of one of said flanges positioned within said slot, the other of said flanges located outside of said slot, whereby said leg may be placed in said slot in at least two ways to yield at least two different heights.

2. The construction of claim 1 wherein said shorter flange is asymmetrically located with respect to the longer flange, such that the distance from one end of the shorter flange to one end of the longer flange is less than the distance from the other end of the shorter flange to the other end of the longer flange, whereby said leg may be placed in said slot in three different ways to yield three different heights.

3. The construction of claim 1 wherein said slot has an abutment at its upper end.

4. The construction of claim 1 wherein said member is a tilted display rack having front and back walls, a pair of opposite side walls, a bottom wall having a plurality of parallel slots therein, each slot having a gravity operated pusher element slidable therein, a plurality of parallel walls defining troughs for receiving toothbrushes, said parallel walls located between said slots, said back wall having said T shaped slot.

5. The construction of claim 4 wherein each said pusher element is provided with a depending tongue which extends through a respective said slot, and wherein one end of each of said slots is provided with opposing dimples for frictionally and releasably engaging opposite sides of a respective said tongue.

6. A leg for yielding various heights of an object to be supported on a horizontal surface when said leg is placed in different ways into a T shaped slot in said object, said leg having at least a portion of its length in the shape of an H shaped beam having a central web and two flanges, each of said flanges having edges, one of said two flanges being shorter than the other of said flanges, one end of one of said flanges positioned within said slot, the other of said flanges located outside of said slot, whereby said leg may be placed in said slot in at least two ways to yield at least two different heights.

7. The leg and slot construction of claim 6 wherein said shorter flange is asymmetrically located with respect to the longer flange, such that the distance from one end of the shorter flange to one end of the longer flange is less than the distance from the other end of the shorter flange to the other end of the longer flange, whereby said leg may be placed in said slot in three different ways to yield three different heights.

8. The leg and slot construction of claim 6 wherein the length of said leg is equal to the length of the longer of said flanges.

9. The leg and slot construction of claim 6 wherein the length of said leg is longer than the length of either of said flanges.

10. The leg and slot construction of claim 6 wherein the entire length of the edges of each of said flanges is biased.

11. The leg and slot construction of claim 6 wherein the first of said two flanges has two ends, both edges at one end only of said first flange being biased, the second of said two flanges having two ends and a middle section, the edges of said ends only of said second flange being biased.

12. The leg and slot construction of claim 11 wherein said edges of said ends only of said second flange are biased in opposite directions.

13. The leg and slot construction of claim 11 wherein said middle portion of said second flange is provided with an abutment at both ends thereof.

14. The leg and slot construction of claim 11 wherein said biased edges of said first flange each terminate in an abutment along the length of said first flange.

* * * * *